US005928008A

United States Patent [19]

Munshi

[11] Patent Number: 5,928,008

[45] Date of Patent: Jul. 27, 1999

[54] EARTHING MODULE

[75] Inventor: Rafik Munshi, Lakehaven, Australia

[73] Assignee: Krone Aktiengesellschaft, Berlin, Germany

[21] Appl. No.: 08/843,955

[22] Filed: Apr. 18, 1997

[30] Foreign Application Priority Data

Apr. 19, 1996 [DE] Germany ..... 196 17 114

[51] Int. Cl.[6] ..... H01R 4/66

[52] U.S. Cl. ..... 439/94; 439/716

[58] Field of Search ..... 439/94, 716

[56] References Cited

U.S. PATENT DOCUMENTS 4,234,239 11/1980 Wilmes et al. ..... 439/94

FOREIGN PATENT DOCUMENTS 0 556 560 B1 1/1993 European Pat. Off. .

9203970 U 6/1992 Germany .

3903752 6/1993 Germany .

4333263 9/1995 Germany .

195 37 528 A1 4/1997 Germany .

*Primary Examiner*—Gary Paumen

*Assistant Examiner*—Antoine Ngandjui

*Attorney, Agent, or Firm*—McGlew and Tuttle, P.C.

[57] ABSTRACT

An earthing module for the termination of earthing conductors to contact elements and for latching on rails, where quick, convenient and reliable connection and disconnection of one or several earthing lines is possible for a large range of wired diameters. An earthing plate is connected on either side optionally to a known insulation displacement contact with inclined insertion portion via a central tapping portion or to a screw contact terminal or on its one side to an insulation displacement contact with inclined insertion portion via the central tapping portion 15 thereof and on its other side to a screw contact terminal.

20 Claims, 3 Drawing Sheets

EARTHING MODULE

FIELD OF THE INVENTION

The present invention relates to an earthing module for the termination of earthing or grounding conductors to contact elements and for latching on rails.

BACKGROUND OF THE INVENTION

Earthing (grounding) modules of this type are used in conjunction with line terminals according to DE 43 33 263 C2 for the connection of conductors for voltages up to 1000 V.

In DE 43 33 263 C2 there is described a line terminal wherein insulation displacement contacts are disposed separately from each other in a plastic housing. Each insulation displacement contact element is connected to a central tapping portion and can be connected thereby to functional plugs. The incoming and outgoing conductors connected to the insulation displacement contact elements of the line terminal are initially not electrically connected to each other. The connection is achieved by connection plugs via the central tapping portions, e.g. by earthing plugs.

Moreover, a termination device is known in the art (DE application 195 37 528), by means of which various termination jobs can be done by a modular design. A base element with receiving portions for the incoming and outgoing cables is latched onto a carrier rail. Between the receiving portions for the termination elements can be inserted functional components, such as an overvoltage/overcurrent protection device.

The prior art line terminal and the prior art termination device are suitable for the termination of wires having diameters from 1 $mm^2$ up to 2.5 $mm^2$ to the insulation displacement contact elements and cannot be used for larger wire diameters above 2.5 $mm^2$, since for wire diameters exceeding 2.5 $mm^2$ higher contacting forces are required that can only be handled by the known screw terminal terminations, up to 4 $mm^2$.

In EP 0 556 560 B1 is described a protective conductor terminal to be latched onto a carrier rail and including terminals for the termination of conductors being in connection to an electrically conductive plate that in turn can be connected to the carrier rail.

The employed termination technique is particularly disadvantageous in not permitting the insulation displacement technique in the termination area and requiring stripping of the conductors to be terminated. Also disadvantageous is that attachment and removal of the terminated conductors is only possible with a tool.

SUMMARY AND OBJECTS OF THE INVENTION

It is therefore the object of the invention to develop an earthing (grounding) module by means of which quick, convenient and reliable connection and disconnection of one or more earthing (grounding) lines is possible for a large range of wire diameters.

The solution of this object is achieved by a first connection attachment having an insulation displacement contact and a central tapping portion and a second connection attachment having a screw contact terminal and a central tapping portion. An earthing plate is provided which has rail means for latching onto the rail. The earthing plate includes lug means for connecting to two of the first and second connection attachments in any combination. The lug means holds one of the connection attachments on one side of the earthing (grounding) plate and holds another one of the connection attachments to another side of the earthing plate.

The earthing (grounding) plate can thus be on one side optionally connected to the insulation displacement contact element via the central tapping portion thereof and on its other side to a screw terminal connection. By the combination of an insulation displacement contact element and of a screw terminal contact in an earthing module and by the constructional cooperation of both types of termination, connection of a wide range of wire diameters is possible, in particular of such having large diameters. Multiple earthing cables can also be terminated, either on both sides at the respective termination contacts or commonly at a screw contact terminal.

By providing several contact positions at the earthing (grounding) plate a safe overall contact is achieved.

The application of the well known special insulation displacement contacts with inclined insertion portions results in that the forces required for contacting larger wire diameters are reduced.

The earthing modules according to the invention are characterized by a high current loadability.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
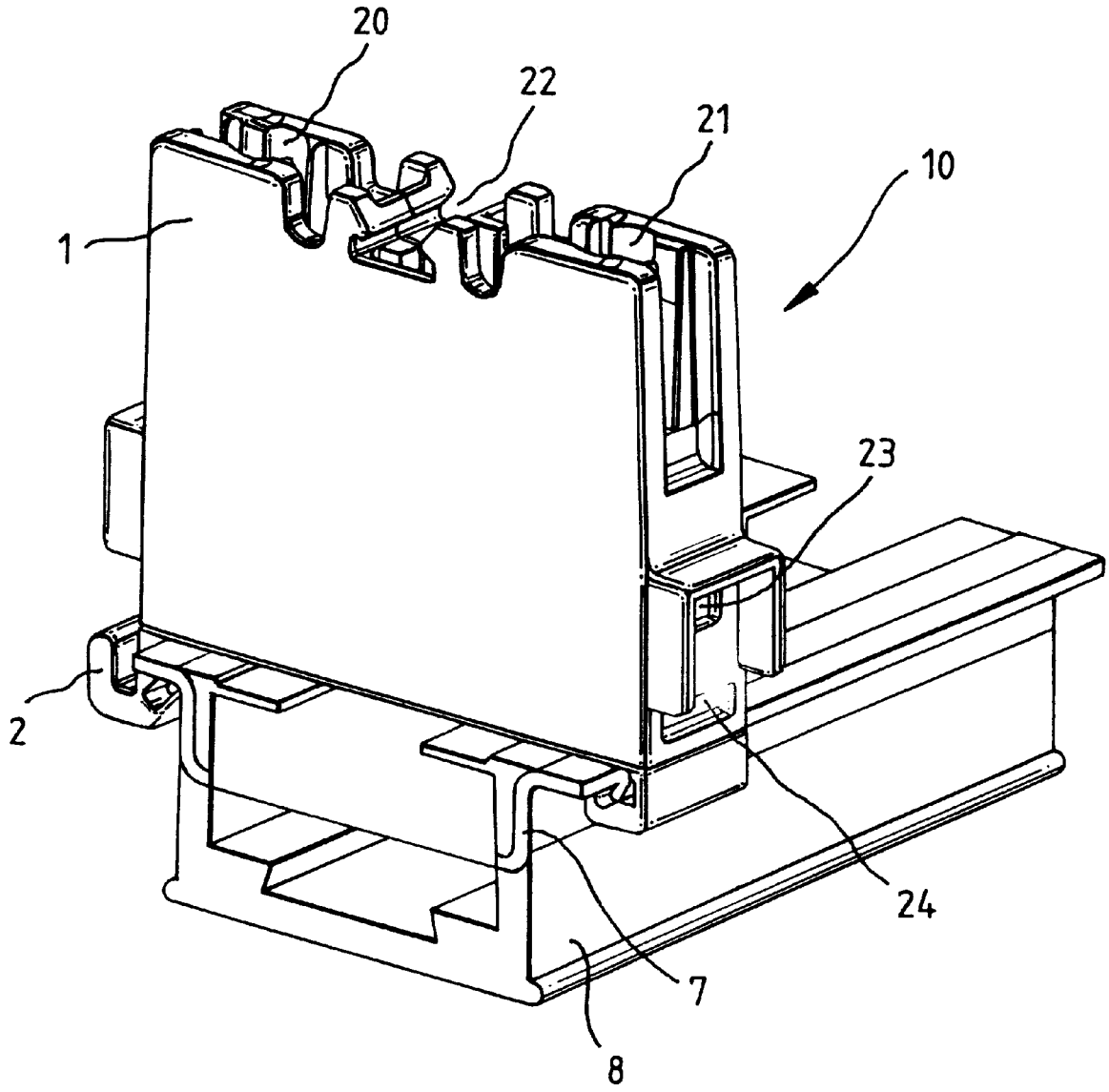
FIG. 1 is a perspective top view of the earthing module.
Figure 3:
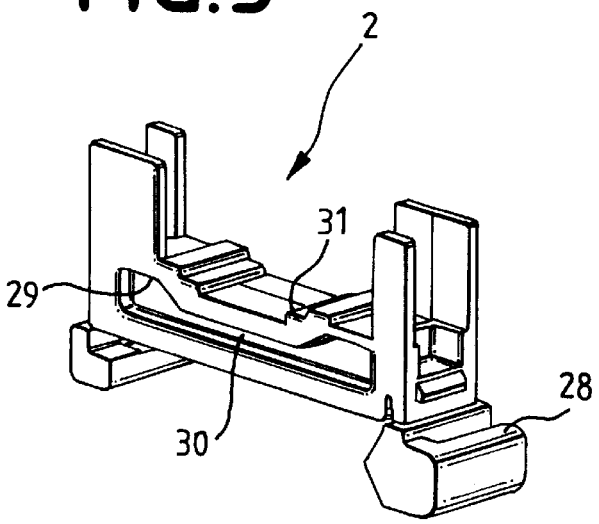
FIG. 3 is a perspective view of the lower part of the earthing module of FIG. 1.

Referring now to FIG. 1, the earthing module 10 substantially comprises a lower housing part 1 with the upper openings 20 to 22, the lateral openings 23, 24, and a lower housing portion 2, shown in FIG. 3, all being latched with each other.

Figure 4:
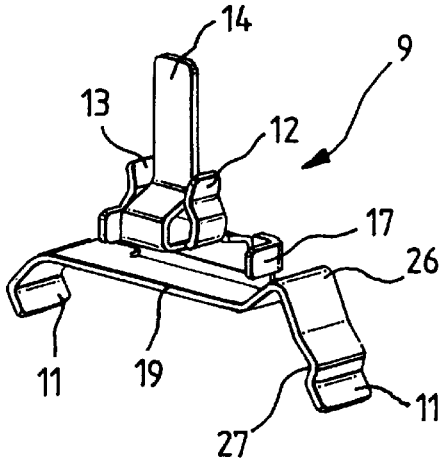
FIG. 4 is a perspective view of the earthing plate in the earthing module of FIGS. 1, 2.
Figure 5:
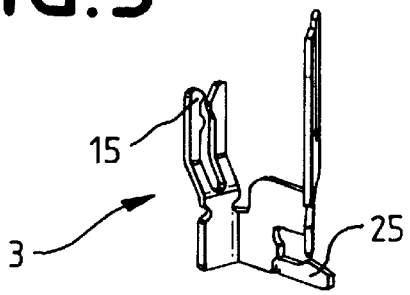
FIG. 5 is a perspective view of an insulation displacement contact element in the earthing module of FIGS. 1, 2.
Figure 6:
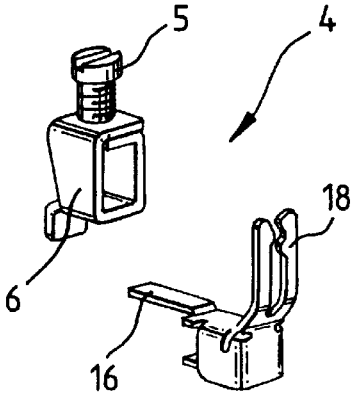
FIG. 6 is a perspective top view of the screw contact of the earthing module of FIGS. 1, 2.

The earthing module 10 has a housing formed of the lower and upper parts 1, 2. In the housing a combination of elements 3, 4, 9, as shown in FIGS. 4 to 6, are connected as to each other. The earthing (grounding) module 10 is latched in the shown example onto a hat-type rail 7 being mounted on a special rail 8 (DIN rail).

The combination of the elements 3, 4, 9 connected to each other form the earthing contact. The earthing (grounding) contact comprises an earthing (grounding) plate 9 and optionally two termination contacts with identical or different termination principles. The earthing plate 9 consists according to the representation in FIG. 4 of laterally multiply angled contact springs 11 being connected in a center and forming a contact area 19 with three contact lug means 12, 13, 14. The contact lugs 12, 13, 14 contact in the assembled condition with laterally inserted termination contacts shown in FIGS. 5, 6. On one side, a connection attachment 3 with an insulation displacement contact and a central tapping portion 15 is connected. Another connection attachment 4 having a screw contact terminal with a contact lug 16 and a central tapping portion 18, as shown in FIG. 6, is connected on another side. The contact lug 16 with the central tapping portion 18 is brought in place in the holder 6 and is held by means of a screw 5 together with the wire to be connected. The screw contact terminal connection attachment 4 can also be formed as one piece.

Identical termination contact types can also be provided on either side, e.g. insulation displacement contact elements 3 cutting on either side.

The angled portions 11 laterally bent off from the central contact area 19 of the earthing plate 9 form a rail means for rigidly mounting the earthing plate 9 in the lower part 2.

By the configuration of the three contact positions at the earthing plate 9 for the termination contacts 3, 4 a high contact reliability is achieved.

The contact springs 11 of the earthing plate 9 grip around the hat-type rail profile and thus establish the earthing connection between the earthing module 10 connected to one or more earthing lines and not shown termination elements 7, 8 on the rail, e.g. line terminals.

The lower part 2, as shown in FIG. 3, is provided with the termination contact elements 9, 3, 4 and latched onto the rail 7.

Figure 2:
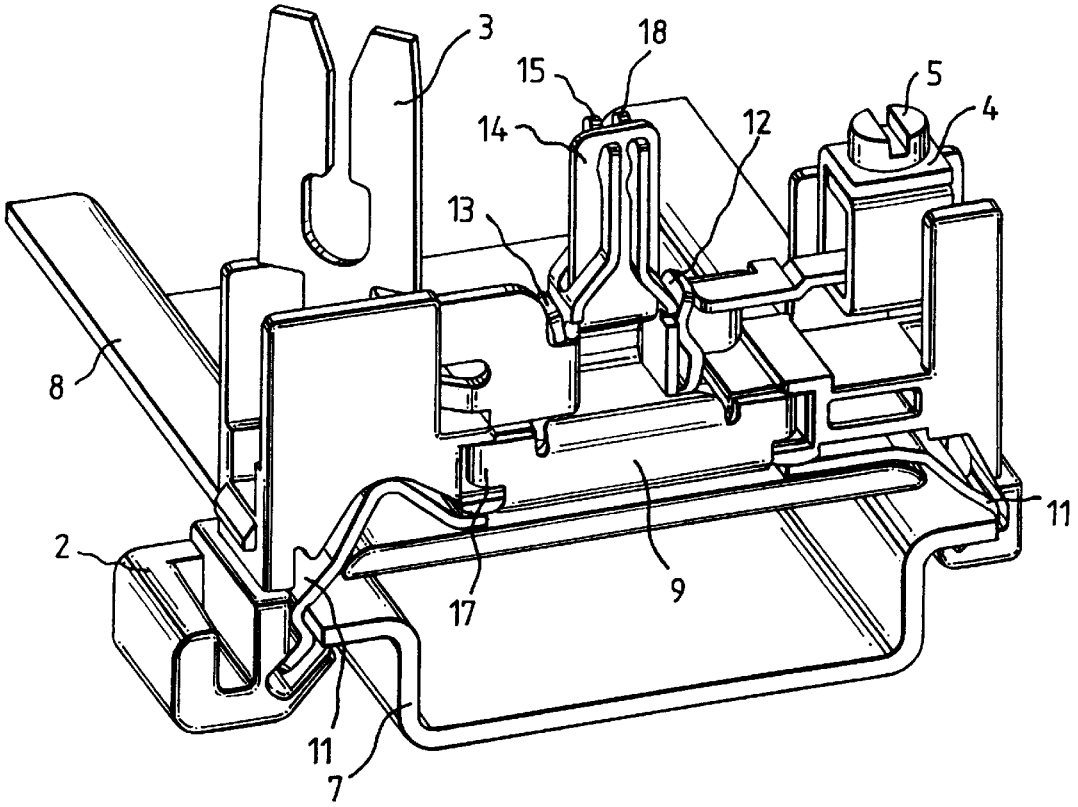
FIG. 2 is a perspective top view of the earthing module of FIG. 1 without an upper part.

Latching to the rail 7 is achieved by the lower portion 27 of the contact springs 11 of the earthing plate 9 and by the latch lugs 28 of the lower part 2. Latching of the earthing plate 9 to the lower part 2 is achieved by the upper portion 26 of the contact springs 11 in contact at a position 29 with the lower part 2, by the central contact portion 19 at the position 30 of the lower part 2, and by the angled portions 17 at the position 31 of the lower part 2 (FIGS. 2 to 4).

The upper part 1 is then slid onto the assembled lower part 2 and is latched there (FIG. 1).

In the upper part 1 there are provided three upper openings 20 to 22. Through openings 20, 21, the cable wires (earthing lines) can be inserted into the insulation displacement contact elements. The central opening 22 serves for insertion of markings or the like or for tapping another earthing line.

The openings 23, 24, laterally provided in the upper part 1, are used for the termination of one or more earthing lines at the screw contact terminal attachment connection 4, opening 23, or for the attachment of a test tapping portion, opening 24. The not shown test tapping portion contacts the contact lug 25 of the insulation displacement contact terminal 3, FIG. 5.

The functional cooperation of insulation displacement contact elements and screw terminal contacts in an earthing module guarantees that earthing terminations can be performed for a wide range of cable diameters, and thus high current/voltage loads can also be achieved.

The earthing module can easily and reliably be latched onto DIN rails 8 (FIG. 1).

While specific embodiments of the invention have been shown and described in detail to illustrate the application of the principles of the invention, it will be understood that the invention may be embodied otherwise without departing from such principles.

What is claimed is:

1. An termination module arrangement for a rail, the arrangement comprising:

a first connection attachment having one of an insulation displacement contact terminal and a screw contact terminal and further having a central tapping portion;

a second connection attachment having one of a screw contact terminal and an insulation displacement contact terminal and further having a central tapping portion;

an earthing plate having rail engagement surfaces for latching onto the rail and making grounding contact with the rail, said earthing plate including a contact lug, said central tapping portion of said first and second connection attachments each being connected physically and in electrical contact with said contact lug for holding one of said connection attachments on one side of said earthing plate and holding another one of said connection attachments on another side of said earthing plate.

2. An arrangement in accordance with claim 1, wherein:

said earthing plate includes a contact area and a plurality of multiply angled contact springs connected at a center to said contact area, said contact lug being connected to said contact area and extending outwardly from said contact area, and further comprising additional contact lugs connected to said contact area and extending outwardly from said contact area.

3. An arrangement in accordance with claim 1, wherein:

said earthing plate is connected to said connection attachments at three contact positions.

4. An arrangement in accordance with claim 1, wherein:

a housing attaches to said earthing plate and said housing is latchable by said earthing plate onto the rail.

5. An arrangement in accordance with claim 1, wherein:

said one side and said another side are on opposite sides of said earthing plate.

6. An arrangement in accordance with claim 1, wherein:

said first connection attachment has a an insulation displacement contact terminal and is connected by said lug contact to said one side of said earthing plate; and said second connection attachment has a an insulation displacement contact terminal and is connected by said lug contact to said another side of said earthing plate.

7. An arrangement in accordance with claim 1, wherein:

said second connection attachment has a screw contact terminal and is connected by said contact lug to said one side of said earthing plate; and said first connection attachment has a screw contact terminal and is connected by said contact lug to said another side of said earthing plate.

8. An arrangement in accordance with claim 1, wherein:

said first connection attachment is connected by said contact lug to said one side of said earthing plate;

said second connection attachment is connected by said contact lug to said another side of said earthing plate.

9. An arrangement in accordance with claim 1, wherein:

said first connection attachment includes an inclined insertion portion.

10. An arrangement in accordance with claim 2, wherein:

said three contact lugs angularly extend from said contact area.

11. An termination module and rail arrangement comprising:

a rail;

a first connection attachment having a central tapping portion and a terminal including one of a screw contact terminal and an insulation displacement contact terminal;

a second connection attachment having a central tapping portion and a terminal including one of a screw contact terminal and an insulation displacement contact terminal; and an ground plate having rail engagement surfaces for latching onto the rail and making electrical contact with the rail, said ground plate including a contact lug, said central tapping portion of said first connection attachment being connected physically and in electrical contact with said contact lug and said central tapping portion of said second connection attachment being connected physically and in electrical contact with said contact lug, thereby holding one of said connection attachments on one side of said ground plate and holding another one of said connection attachments on another side of said ground plate to provide any one of two screw contact terminals, two insulation displacement contact terminals and one screw contact terminal and one insulation displacement contact terminal.

12. An arrangement in accordance with claim 11, wherein:

said ground plate includes a contact area and a plurality of multiply angled contact springs connected at a center to said contact area, said contact lug being connected to said contact area and extending outwardly from said contact area, and further comprising additional contact lugs connected to said contact area and extending outwardly from said contact area, said ground plate being connected to said connection attachments at three contact positions.

13. An arrangement in accordance with claim 11, further comprising:

a housing attached to said ground plate, said housing being latchable by said ground plate onto the rail, said housing including a lower part and an upper part.

14. An arrangement in accordance with claim 11, wherein:

said first connection attachment has a an insulation displacement contact terminal and is connected by said contact lug to said one side of said ground plate; and said second connection attachment has a an insulation displacement contact terminal and is connected by said contact lug to said another side of said ground plate.

15. An arrangement in accordance with claim 11, wherein:

said second connection attachment has a screw contact terminal and is connected by said contact lug to said one side of said ground plate; and said first connection attachment has a screw contact terminal and is connected by said contact lug to said another side of said ground plate.

16. An termination module and rail arrangement comprising:

a rail;

a first connection attachment having a central tapping portion and a terminal including one of a screw contact terminal and an insulation displacement contact terminal;

a second connection attachment having a central tapping portion and a terminal including one of a screw contact terminal and an insulation displacement contact terminal;

an ground plate having rail engagement surfaces for latching onto the rail and making electrical contact therewith, said ground plate including a contact lug, said central tapping portion of said first connection attachment being connected physically and in electrical contact with said contact lug and said central tapping portion of said second connection attachment being connected physically and in electrical contact said contact lug, thereby holding one of said connection attachments on one side of said ground plate and holding another one of said connection attachments on another side of said ground plate to provide any one of two screw contact terminals, two insulation displacement contact terminals and one screw contact terminal and one insulation displacement contact terminal; and a housing attached to said ground plate, said housing being latchable with said ground plate onto said rail.

17. An arrangement in accordance with claim 16, wherein:

said ground plate includes a contact area and a plurality of multiply angled contact springs connected at a center to said contact area, said contact lug being connected to said contact area and extending outwardly from said contact area, and further comprising additional contact lugs connected to said contact area and extending outwardly from said contact area, said ground plate being connected to said connection attachments at three contact positions.

18. An arrangement in accordance with claim 16, wherein:

said first connection attachment has a an insulation displacement contact terminal and is connected by said contact lug to said one side of said ground plate; and said second connection attachment has a an insulation displacement contact terminal and is connected by said contact lug to said another side of said ground plate.

19. An arrangement in accordance with claim 16, wherein:

said second connection attachment has a screw contact terminal and is connected by said contact lug to said one side of said ground plate; and said first connection attachment has a screw contact terminal and is connected by said contact lug to said another side of said ground plate.

20. An arrangement in accordance with claim 16, wherein:

said second connection attachment has a screw contact terminal and is connected by said contact lug to said one side of said ground plate; and said first connection attachment has an insulation displacement contact terminal and is connected by said contact lug to said another side of said ground plate.

* * * * *